US005364503A

United States Patent [19]

Solinas et al.

[11] Patent Number: 5,364,503

[45] Date of Patent: Nov. 15, 1994

[54] NITRIC OXIDE TREATMENT FOR OZONE BLEACHING

[75] Inventors: Marco Solinas, Vancouver; Thomas H. Murphy, Burnaby, both of Canada

[73] Assignee: MacMillan Bloedel Limited, Vancouver, Canada

[21] Appl. No.: 838,169

[22] Filed: Feb. 20, 1992

[51] Int. Cl.[5] ..... D21C 9/153

[52] U.S. Cl. ..... 162/65; 162/76; 162/80; 162/81

[58] Field of Search ..... 162/65 B, 76, 81, 80

[56] References Cited

FOREIGN PATENT DOCUMENTS 2505377 11/1982 France .
WO9118145 11/1991 WIPO .

OTHER PUBLICATIONS

Patt et al., "Application of Nitrogen Dioxide & Ozone in the Pre Bleaching of Kraft & Sulfite Pulps", 1985 International Pulp Bleaching Conference, pp. 37–45 (Pattz).

Patt, R. & Welkener, U. "Bleaching of Baggasse Soda Pulp with Nitrogen Dioxide & Ozone", Holzforzchung, 39 (1985).

Rudra Singh, "Ozone replaces chlorine in the first bleaching stage", Tappi, Feb. 1982, vol. 65, No. 2, pp. 45–48.

Lachenal et al. "Improvement of Ozone Prebleaching of Kraft Pulps", J. Pulp & Paper Science, vol. 12, No. 2, Mar. 1986, J50–J53.

"Production of Bleached Chemical Pulp in the Future", Int. Pulp Bleaching Conf. 1991, Sweden, Jun. 11–14 1991, vol. 3.

"Achieving High Pulp Brightness & Good Pulp Strength Without Any Chlorine Bleaching Compounds," by Macas Tadas, Jiang & Becker "Strength Characteristics of KP Bleached by Multistage Ozone Bleaching" by Kobayashi, T. et al., Japan TAPPI, 31(12), pp. 807–811, 1977.

Nitrogen (II) and Nitrogen (III) Compounds During Treatment of Kraft Pulp and Kraft Lignin with $NO_2$, published in Nordic Pulp and Paper Research Journal No. 3, 1988, pp. 138–144 by Dennis Rasmussen and Olof Samuelson.

Optimization of Bleaching Sequences using Peroxide as a First Stage, 1982 International Pulp Bleaching Conference, B. Lachenal et al.

Improvement of Ozone Pre-Bleaching of Kraft Pulps, International Pulp Bleaching Conference, 1985, Lachenal et al.

*Primary Examiner*—W. Gary Jones
*Assistant Examiner*—Dean T. Nguyen
*Attorney, Agent, or Firm*—C. A. Rowley

[57] ABSTRACT

A method of bleaching a chemical pulp by adjusting the pH of the pulp to 1.5–3.5, chelating the pulp and then treating the pulp in an N stage with nitric oxide (NO) in the amount of at least 1.5% by weight of the oven dried pulp at a consistency of between 30 and 55% and further treating the pulp in a Z stage with ozone to produce a bleach pulp having a higher viscosity for a given permanganate number compared with a similar pulp bleached without using the N stage.

30 Claims, 7 Drawing Sheets

NITRIC OXIDE TREATMENT FOR OZONE BLEACHING

FIELD OF THE INVENTION

The present invention relates to the bleaching of chemical pulps. More specifically the present invention relates to pretreatment of chemical pulp with nitric oxide prior to ozone bleaching.

BACKGROUND OF THE INVENTION

Ozone bleaching is gaining more and more acceptance in the pulp and paper industry and is now commercially employed in a pulp mill in Austria to treat a sulphite pulp.

It is known that pretreating pulps containing cellulose and lignin with nitrogen oxides prior to oxygen bleaching improves the bleaching operation. This concept is discussed in a paper by Dennis Rasmussen and Olof Samuelson entitled *Nitrogen (II) and Nitrogen (III) Compounds During Treatment of Kraft Pulp and Kraft Lignin with* $NO_2$ published in Nordic Pulp and Paper Research Journal No. 3, 1988, pages 138–144.

A number of different authors have described the use of nitric oxide which converts to nitrogen dioxide ($NO_2$) on contact with oxygen ($O_2$) as a pretreatment prior to ozone ($O_3$) bleaching. These teachings discuss treating the pulp with $NO_2$ at temperatures in the order of about 70°–90° C. and the results showed no increase in the ratio of viscosity to permanganate number over the control. Attention is directed specifically to the following publications.

1. *Optimization of Bleaching Sequences using Peroxide as a First Stage,* 1982 International Pulp Bleaching Conference, B. Lachenal et al.

2. *Application of Nitrogen Dioxide and Ozone in the Pre-Bleaching of Kraft and Sulphite Pulps,* 1985 International Pulp Bleaching Conference, Pratt et al.

3. *Improvement of Ozone Pre-Bleaching of Kraft Pulps,* International Pulp Bleaching Conference, 1985, Latchenal et al (see also Journal of Pulp and Paper Science, Volume 12, No. 2, March 1986).

4. *Bleaching of Bagasse Soda Pulp with Nitrogen Dioxide and Ozone,* Holzforzchung, 39 (1985), pp.305–310 by Pratt et al.

The paper *Laboratory and Pilot Plant Bleaching of Various Pulps with Ozone* by Pratt et al, 1984 Oxygen Delignification, pp.33–42, describes experiments carried out by Pratt et al wherein pulp was treated with $NO_2$ gas and ozone. Generally the treatment occurred in a refiner and in one example the treatment was carried out at a consistency of 40% at a temperature of 30° C. (the paper indicates on page 36 that the optimum temperature for nitrogen dioxide treatment is around 70° C. however because they were applying a combined $NO_2$-/$O_3$ treatment an intermediate temperature to the optimum temperatures for ozone and $NO_2$ was applied). The conclusion was that for those treatments incorporating $NO_2$, the yield, bleachability and mechanical pulp properties were inferior to those obtained with pure ozone stage.

It is suspected that the amount of $NO_2$ added which was always maintained low (about 1% on the oven dry weight of the pulp) produced no benefit.

BRIEF DESCRIPTION OF THE PRESENT INVENTION

It is an object of the present invention to provide an improved system of bleaching pulp wherein the pulp is pretreated with nitric oxide and then ozone to produce a pulp having a higher viscosity for a given permanganate number compared with a similar pulp bleached without a pretreatment with nitric oxide.

Broadly the present invention relates to a method of bleaching pulp comprising adjusting the pH of the pulp to 1.5–3.5 chelating the pulp and reacting the chelated pulp in an N stage with nitric oxide in an amount of at least 1.5% by weight of NO based on the oven dry weight of the pulp and further treating said pulp in a Z stage with ozone to consume 0.1 to 6% ozone based on the oven dry weight of the pulp, said N and said Z stages each being carried out at a temperature of less than 35° C. to produce a bleach pulp with a higher viscosity at a given permanganate number compared with a similarly bleached pulp without an N stage.

Preferably said pulp is fluffed as it enters said N stage.

Preferably the consistency of the pulp during the N and Z stages is in the range of 30–55%.

Preferably the NO applied in said N stage will be in the range of 2–8% based on the oven dry weight of the pulp.

Preferably said N stage will be for a period of time of 5–10 minutes.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
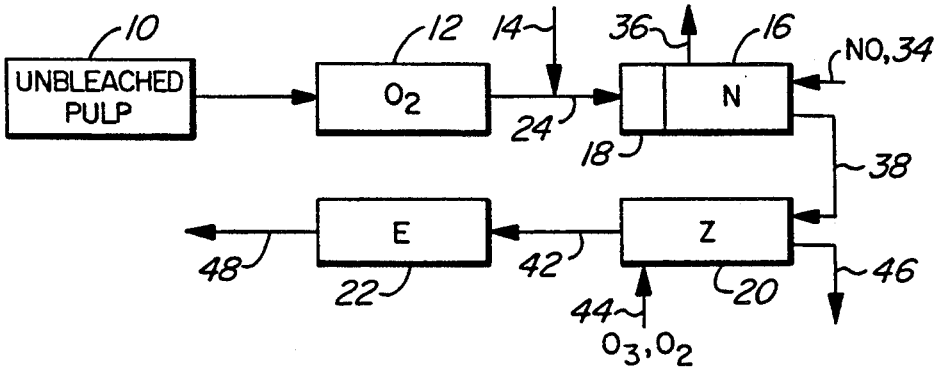
FIG. 1 is a schematic flow diagram of one embodiment of the process of the present invention.

As shown in FIG. 1 the unbleached pulp as indicated at 10 is preferably carried to an oxygen stage (0 stage) as indicated at 12 wherein the unbleached pulp is subject to extended delignification in an oxygen stage. The 0 stage 12 is optional and may be eliminated or replaced with other suitable extended delignification processes. Acid is added to the pulp as indicated at 14 to reduce the pH of the pulp to the range of about 1.5 to 3.5 preferably 2–2.5 before the pulp is subject to an N stage as indicated at 16. Generally the pulp is fluffed in a fluffer schematically indicated at 18 before it is introduced at the N stage.

In the N stage 16 gaseous nitric oxide (NO) is added to the fluffed pulp at the pH of 1.5–3.5 (preferably 2 to 2.5) in an amount to apply between 1.5 and 8% NO based on the oven dry weight of the pulp. The NO is converted to gaseous nitrogen dioxide ($NO_2$) on contact with oxygen and the $NO_2$ reacts with the pulp at a temperature not exceeding about 35° C. for a time of 5–15 minutes (preferably 5–10 minutes).

The pulp is then carried into a Z stage as indicated at 20 wherein the pulp is treated with ozone at a temperature of below about 35° C. (preferably the same temperature as the N stage) to consume up to 6% ozone (preferably between 0.3 and 2%) based on the oven dry weight of the pulp. Preferably the ozone will be carried in an oxygen gas in a concentration of ozone in oxygen of the highest ozone concentration practical, e.g. available from the ozone generator. Present ozone generator technology allows generally about 6 to 8% ozone in oxygen. The reaction of ozone with the pulp is fast and normally will be complete in 1 to 2 minutes.

Generally after the Z stage 20 the pulp will be washed and then be subjected to a suitable extraction stage or E stage 22 which may include caustic extraction with or without the presence of oxygen and/or peroxide.

Figure 2:
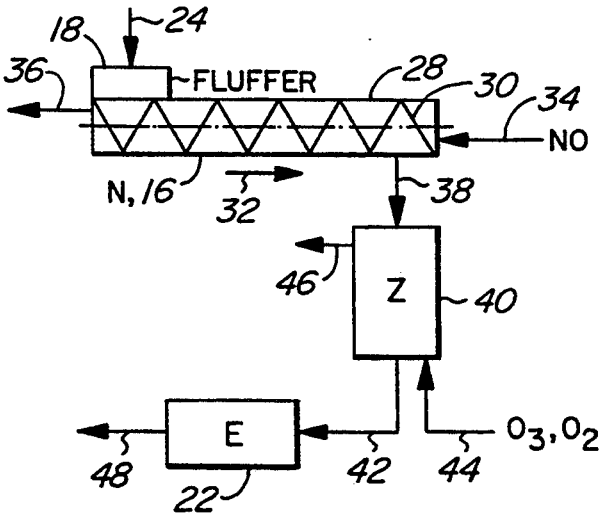
FIG. 2 is a schematic illustration of a suitable arrangement of apparatus for carrying out the nitric oxide and ozone bleaching stages.

The reactor shown in FIG. 2 may be any suitable form of reactor for the N stage. In the arrangement shown in FIG. 2 pulp to be bleached is introduced as indicated by a line 24 into the fluffer 18 where it is broken into small particles and introduced into a vessel 28 having a suitable conveyer means 30 conveying and tumbling the pulp as indicated by the arrow 32 toward the right side of the figure to obtain contact between the pulp and the $NO_2$ in the surrounding atmosphere and thereby facilitate the reaction. A suitable system might be as illustrated in U.S. Pat. No. 4,363,697 issued Dec. 14, 1986 to Markham.

Nitric oxide (NO) is introduced as indicated by the arrow 34 (see also FIG. 1) to treat the fluffed pulp as it travels along the length of the vessel 28 so that the residence time in the vessel 28 determines the time for the $NO_2$ treatment. The $NO_2$ gases and other surrounding gases not consumed are bled from the vessel 28 as indicated by the arrow 36 shown in the dash line.

Pulp from the vessel 28 passes via line 38 into a vessel 40 in which the Z stage 20 (ozone bleaching stage) is carried out. Examples of vessels suggested for the Z stage bleaching are disclosed in U.S. Pat. Nos. 4,278,496 issued Jul. 14, 1981 to Fritzvold and 4,426,256 issued Jan. 17, 1984 to Johnson. The pulp passes through the vessel 40 and as indicated by line 42 into the E stage, i.e. extraction stage 22. The vessel 40 manipulates the pulp to obtain contact between the ozone gas and the pulp.

Ozone gas (in oxygen) enters the vessel 40 as indicated at 44 and travels counter current to the flow of the pulp through the vessel 40 and is removed from the vessel 40 as indicated by the line 46. Thus the time of passage of the pulp through the vessel 40 determines the residence time or contact time between the ozone and the pulp during the Z stage.

The apparatus used in the N and Z stages may be essentially the same as in each stage contact between a gas and a pulp is essential. The two stages N and Z may be easily separated or isolated by introducing valve in the line 38 or a slight pressure differential between the vessels 38 and 40 to ensure that there is little if any flow of gases from vessel 28 to vessel 40.

It is possible to allow flow of ozone through the vessel 28 and remove it as indicated by the line 36 together with the gases exhausted from the N stage so that there is combined N/Z stage prior to the Z stage however this will make recovery and/or recycle of the off gases more difficult.

The pulp in the E stage 22 is treated in the conventional manner either by caustic extraction with or without the presence of oxygen and/or peroxide or other known extraction stages and leaves the system as indicated at 48.

Figure 3:
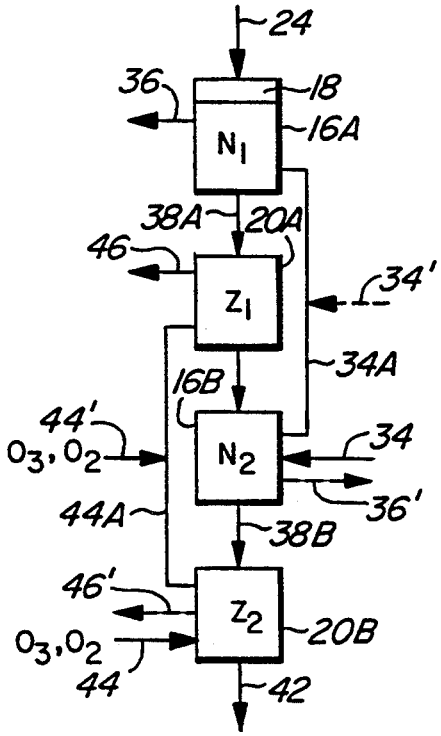
FIG. 3 is a schematic illustration of a modified version of the present invention.

As shown in FIG. 3 the N and Z stages 16 and 20 may be broken down into more than 1 stage, i.e. the N stage may compromise $N_1$ and $N_2$ stage indicated at 16A and 16B, each followed by its corresponding Z stage $Z_1$ and $Z_2$ indicated at 20A and 20B. It has been found that this arrangement wherein the application of nitric oxide and ozone are each applied in two stages improves the process.

The nitric oxide may be applied to the N stages in series, i.e. it may be added at indicated 34 into stage $N_2$ and then carried from stage $N_2$ via line 34A to stage $N_1$ and leave stage $N_1$ via line 36 in the same manner as described hereinabove with the single N stage 16.

Alternatively the nitric oxide may enter into line 34A as indicated at 34' and the flow split, one for the portion flowing in one direction into stage $N_1$ and be removed via line 36 and a second portion flowing in the opposite direction into stage $N_2$ and leaving via line 36'. Yet a further alternative is to operate the stage $N_1$ and $N_2$ as independent N stages with concurrent or counter current flow of the $NO_2$ and the pulp.

The supply of ozone to the $Z_1$ and $Z_1$ stages may be similar to that for the N stages. As illustrated the line 44 may introduce ozone into stage $Z_2$ and be carried by line 44 A to stage $Z_1$ from which residual is removed by line 46 for recovery. Alternatively the ozone may be added via line 44' to line 44A and then introduced separately into the stages $Z_1$ with excess removed via line 46 and to $Z_2$ with excess removed as indicated by line 46' and sent to recovery or the stage $Z_1$ and $Z_2$ may be operated as independent Z stages employing concurrent or counter current flow of the $O_3$ and the pulp.

The total NO or $O_3$ applied will be essentially the same with the FIG. 3 embodiment, however the application in each stage, i.e. in each N or Z stage may be selected as desired, care being taken that sufficient NO or $O_3$ is added to the stage to obtain the desired result. For example assuming a total of 4% NO is to be add 2% may be added in $N_1$ and 2% in $N_2$ or 3% in $N_1$ and 1% in $N_2$. Similarly the amount of $O_3$ added in $Z_1$ and $Z_2$ may be equal or otherwise divided preferably in a similar ratio as the application of NO.

FIGS. 4 to 8 inclusive are curves that illustrate the effect of the present invention relative to pulp properties which as is well understood in the art are better the higher the viscosity at a given permanganate number. In the laboratory test used to generate these curves, the pulp treated (brown stock) had a Kappa No. 29.6 mls and viscosity 31.5 cp and was not subjected to an 0 stage.

The N stage and Z stage were both carried out at a pH of about 2.25, a temperature of 22° C., a consistency of about 40%, and for times of 5–10 minutes and 2–4 minutes respectively. The conditions of the E stage were as follows: NaOH on pulp 1.5%; temperature 70° C.; time 60 minutes and consistency 10%. These conditions (unless otherwise stated) were used to generate the date presented in FIGS. 4 to 14 inclusive.

In FIGS. 4 to 8

■ =the control;

○=1% nitric oxide application base on the oven dry weight of the pulp

Δ=6% nitric oxide application and

● =application of nitric oxide as specified.

Figure 4:
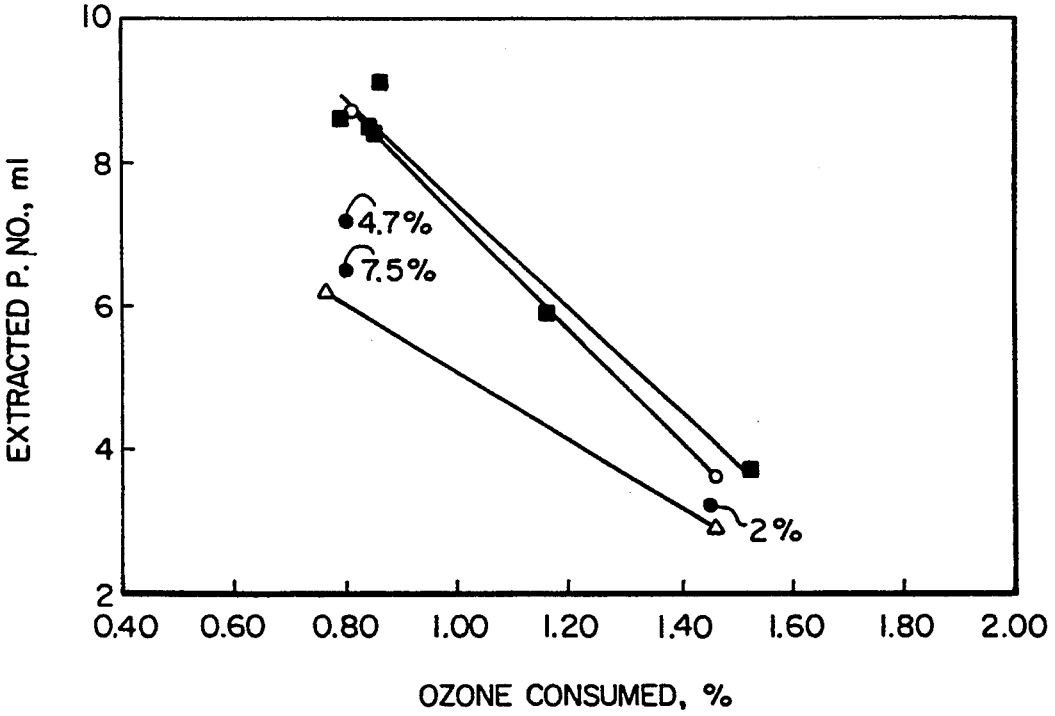
FIG. 4 is a plot of ozone consumed versus permanganate number of the treated pulp after extraction.

As illustrated in FIG. 4, for additions of nitric oxide of over about 2% the permanganate number after the Z and E stages for a given amount of ozone consumed is significantly lower than the permanganate number for a similar pulp with up to 1% nitric oxide applied.

Figure 5:
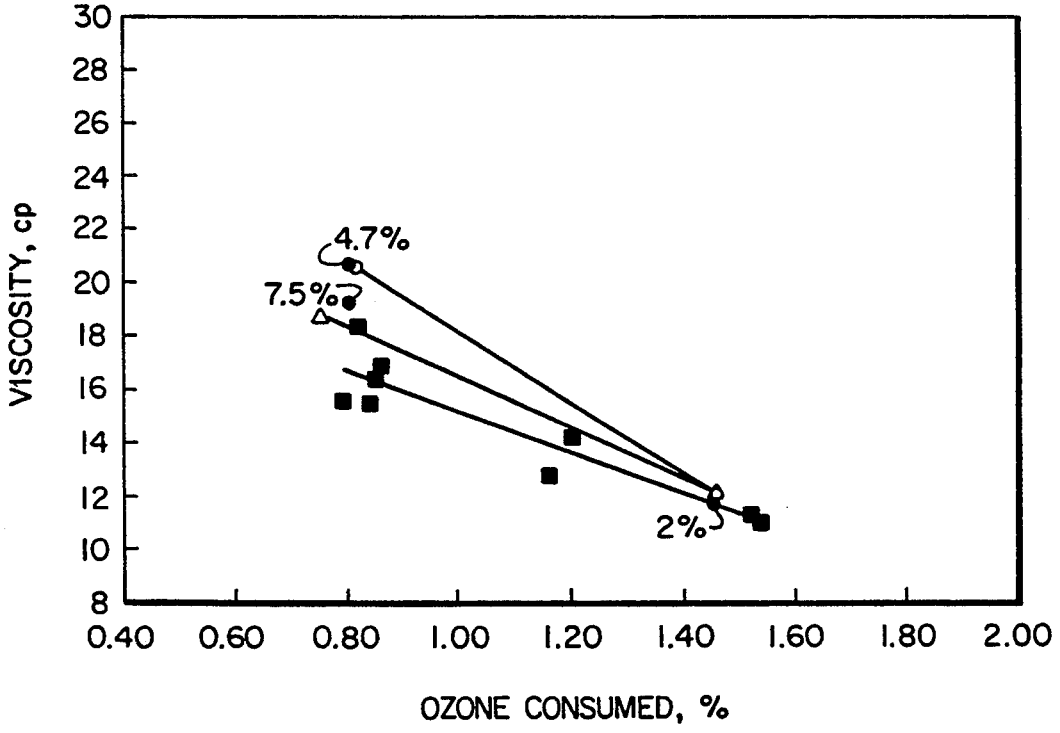
FIG. 5 shows a plurality of plots for different nitric oxide applications of ozone consumed as a percentage of the oven dry weight of the pulp versus viscosity of the pulp in centipoises.

FIG. 5 shows the relationship between ozone consumed and viscosity of the extracted pulp, it being apparent that for a given consumption of ozone, the viscosity of the pulp is equal or greater than that obtained without nitric oxide application.

Figure 6:
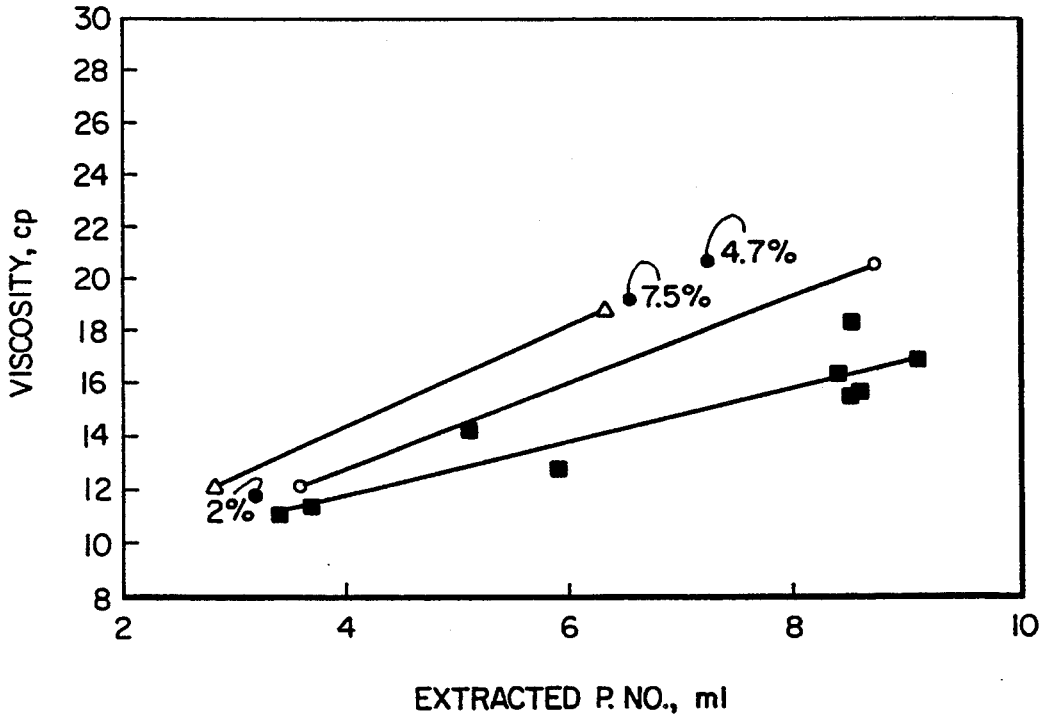
FIG. 6 are plots of nitric oxide applied showing the relationship of the extracted permanganate number (after a Z and E stage) versus viscosity in centipoises.

It will be apparent from FIG. 6 that the viscosity of the extracted pulp for a given permanganate number is higher for a pulp treated with nitric oxide when compared with the control. Thus for a given ozone consumption in FIG. 4 the permanganate number is lower when the pulp is treated with NO and the viscosity higher as shown in FIG. 5. These results are confirmed in FIG. 6 which indicates for a given permanganate number the viscosity of the extracted pulp when pretreated with nitric oxide was found to be significantly higher.

Figure 7:
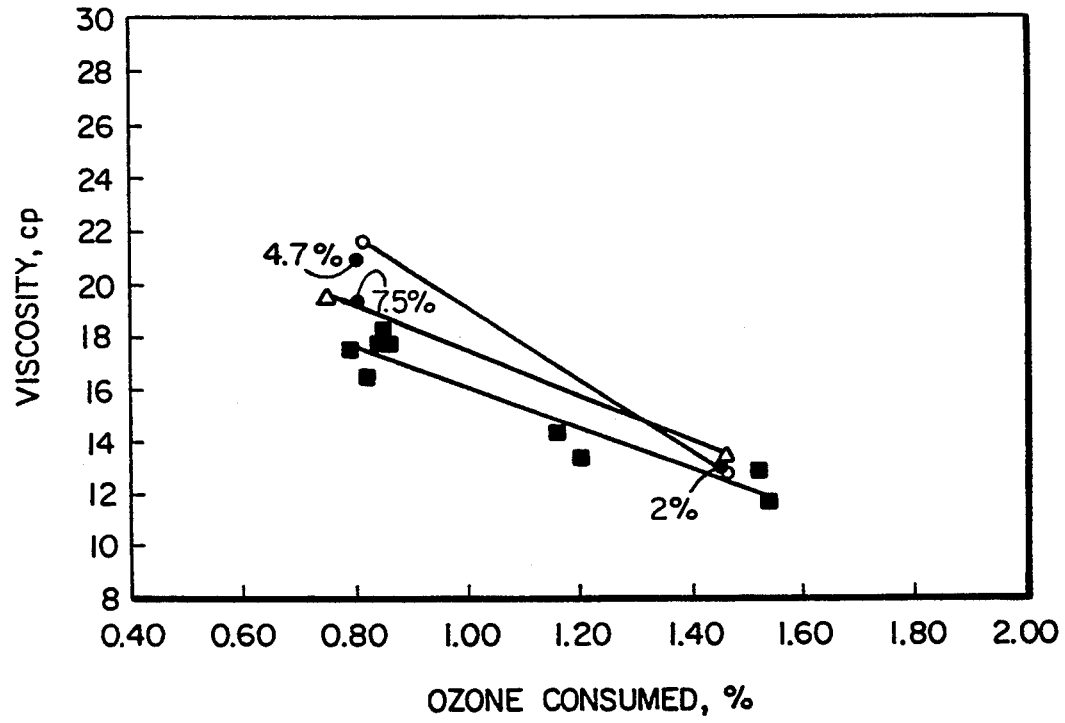
FIG. 7 shows plots of ozone consumed as a percentage of the oven dry weight of the pulp versus viscosity in centipoises of the treated pulp.
Figure 8:
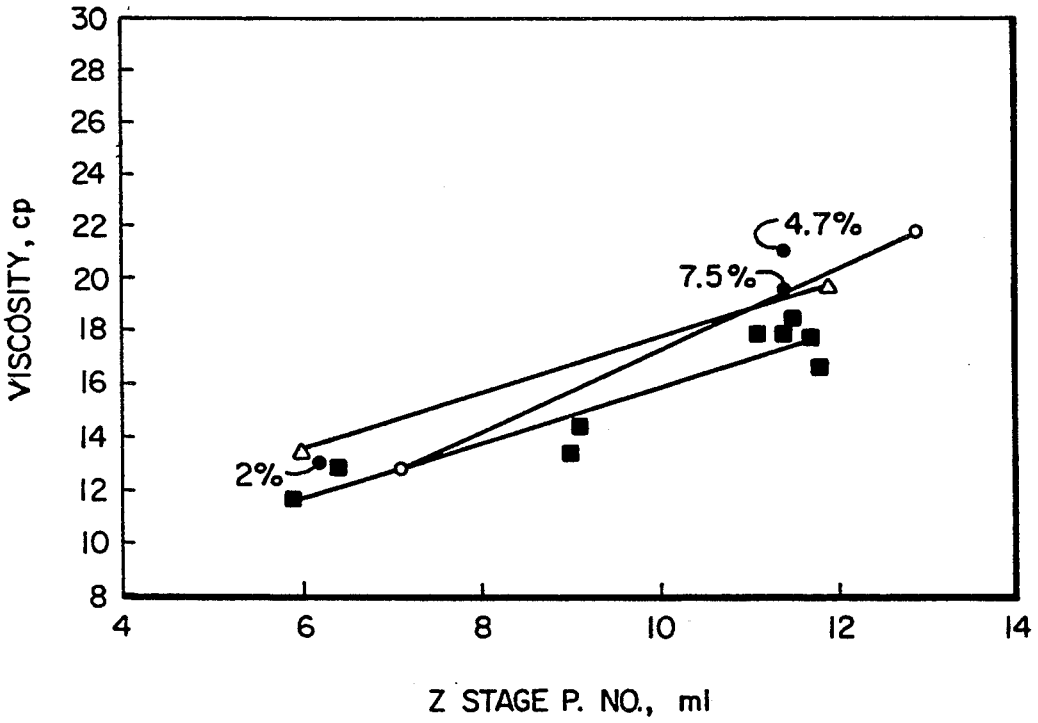
FIG. 8 shows plots of the permanganate number (p number) after ozone treatment plotted against viscosity for different nitric oxide applications.

FIGS. 7 and 8 further confirm these results with respect to pulp not subject to extraction, i.e. tested immediately after the Z stage. As shown in FIG. 7 for a given percent of ozone consumed the viscosity is higher when the pulp is pretreated with nitric oxide and as shown in FIG. 8 the viscosity is higher for a given permanganate number, however the results obtained after extraction are superior.

It is also apparent from these curves that the effect of viscosity versus permanganate number is more pronounced for the pulp after extraction than it is following the ozone stage.

Figure 9:
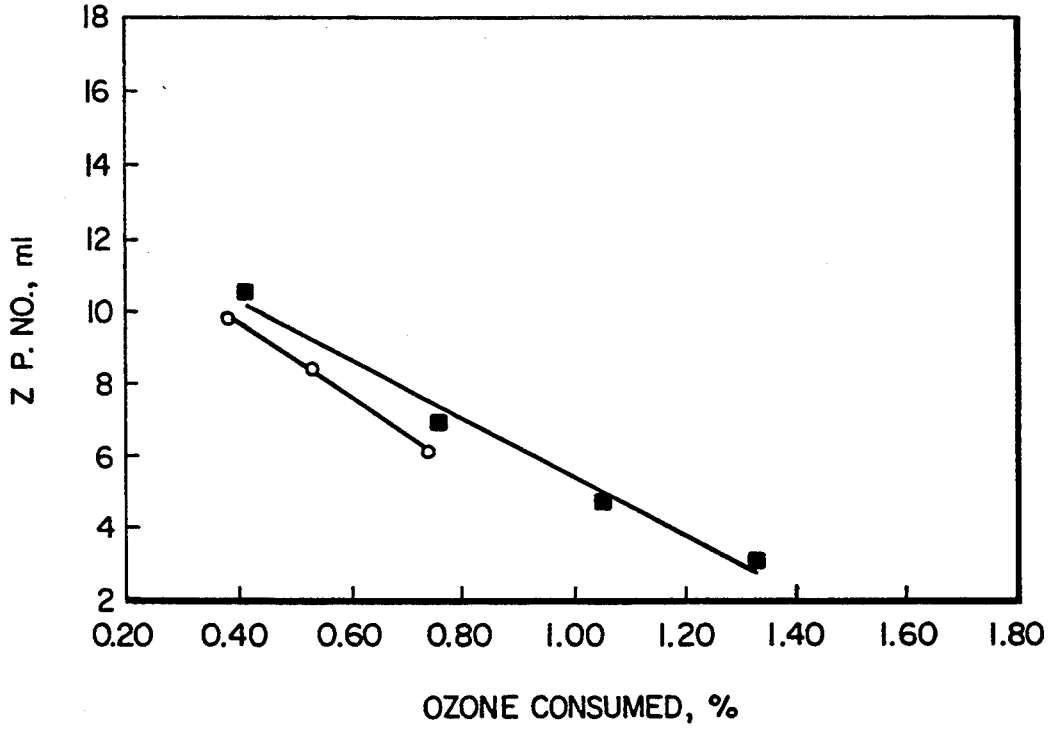
FIGS. 9 and 10 show curves of permanganate number after the Z stage and after the E stage respectively versus ozone consumed for a process wherein the pulp is treated with oxygen prior to the present invention.
Figure 10:
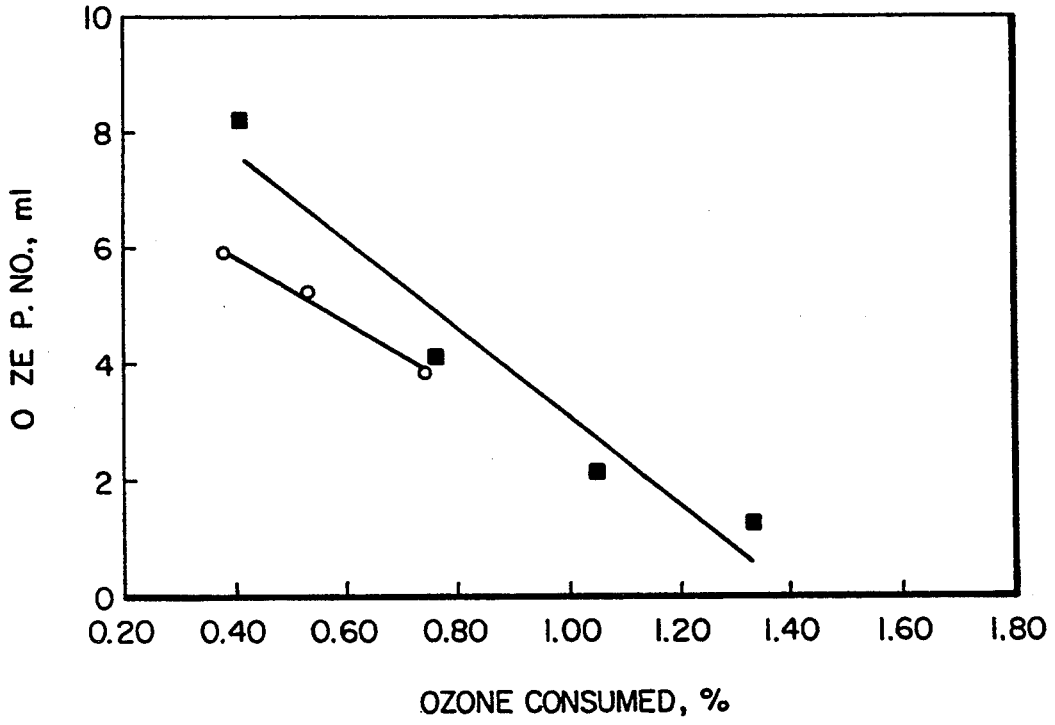
Figure 11:
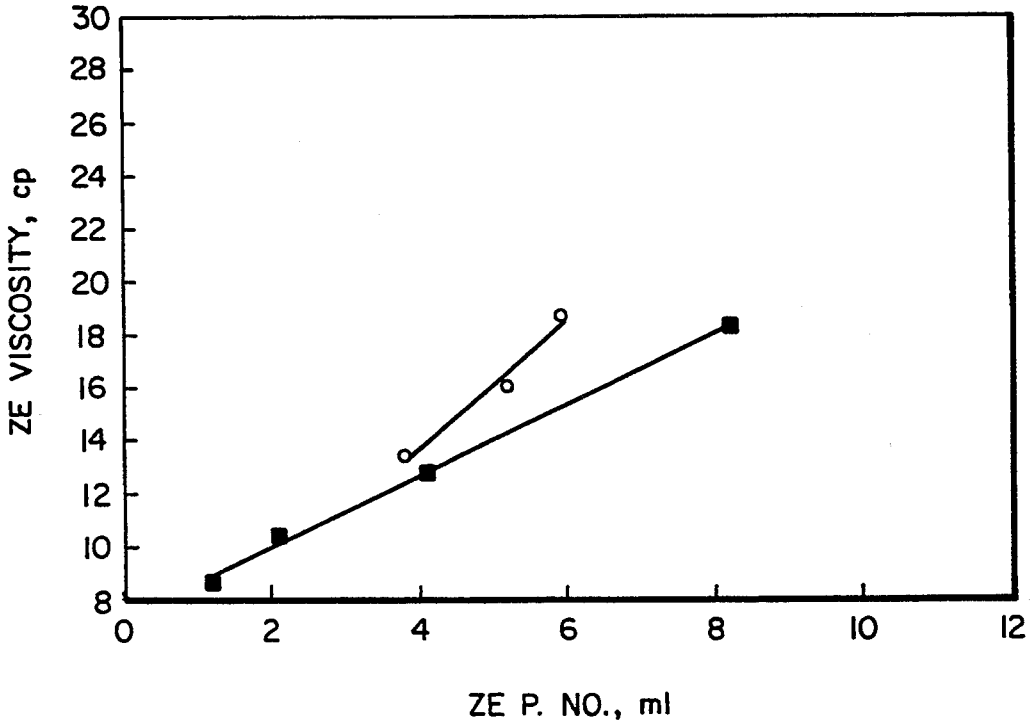
FIG. 11 is a plot of viscosity after extraction versus permanganate number after extraction for a pulp pretreated by oxygen bleaching prior to application of the present invention.

To generate the data presented in FIGS. 9, 10 and 11 the brown stock used for FIGS. 4 to 8 inclusive was first subjected to an 0 Stage before being processed by the present invention. The pulp, after the 0 stage, had a Kappa No. of 21.1 mls and a viscosity of 26.5 cp.

In FIGS. 9, 10 and 11

■ represents the process OZ or OZE in the case where the measurements are made after the E stage and ○ represent the ONZ or ONZE depending on whether the measurements are made after the Z or after the E stage based on a total of 2% of NO added to the pulp based on the oven dry weight of the pulp.

As shown in FIG. 9, the addition of 2% NO to the pulp has a minor effect on the permanganate number for a given ozone consumption. This effect seems to increase slightly the greater the ozone consumed.

It will be noted in FIG. 10 that for the same amount of ozone consumed the change in permanganate number after extraction (E) appears to be more pronounced, i.e. at 6% ozone consumed the permanganate number drops from about 6 to $4\frac{3}{4}$ in FIG. 10 whereas in FIG. 9 the drop was from about $8\frac{1}{2}$ down to about $7\frac{1}{2}$.

From FIG. 11 it is apparent that relative to the control at a permanganate number of 6, the viscosity of the extracted pulp is increased significantly when the present invention is employed, i.e. the viscosity went from about 15 for the control up to $18\frac{1}{2}$ almost 19 when the present invention was applied.

The pulp treated were samples of the same brown stock as used for FIGS. 4 to 8 and the conditions of the N and Z stages were as above described.

Figure 12:
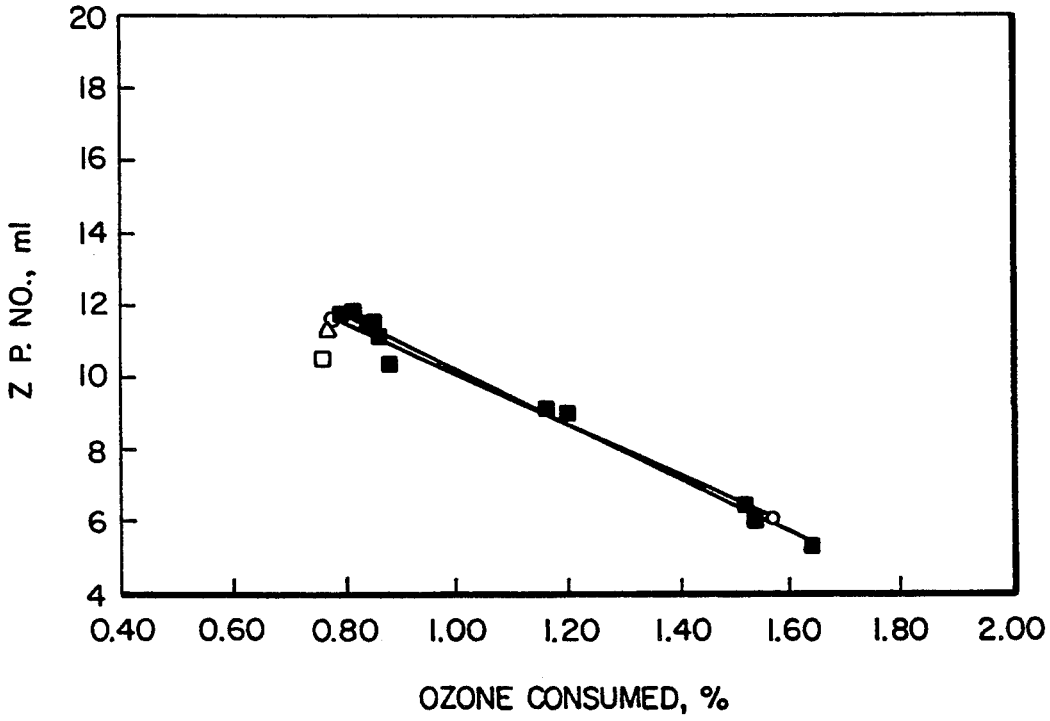
FIGS. 12, 13 and 14 illustrate results obtained following the NZNZE process for permanganate numbers after the second Z stage versus ozone consumed, permanganate number after the E stage versus ozone consumed and viscosity after the E stage versus permanganate number after the E stage.
Figure 13:
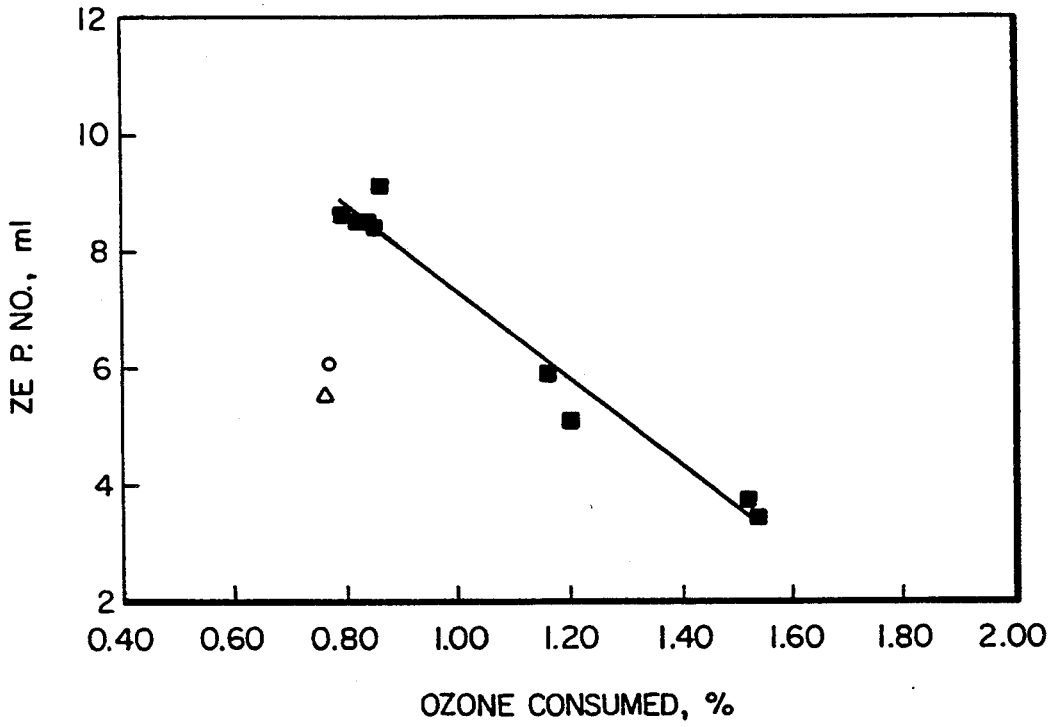
Figure 14:
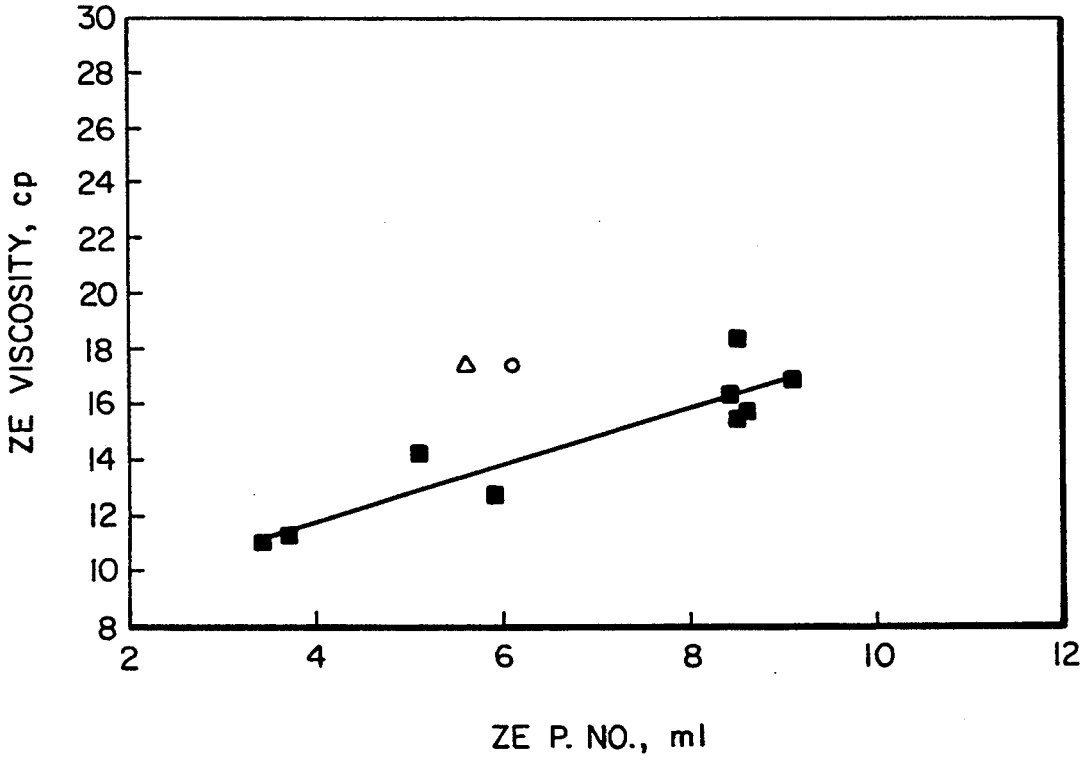

In FIGS. 12, 13 and 14, the symbols represent the following:

■ control

Δ represents the NZNZ process applying 2% NO in each N stage and 0.5% $O_3$ in each Z stage □ the NZNZ process of the present invention wherein 3% NO was added at stage $N_1$ in FIG. 3 and 1% in $N_2$ and 0.5% percent ozone was added in each of the Z stages It can be seen from FIG. 12 that the permanganate number after the Z stage for a given amount of ozone consumed was lowered very slightly for both the balanced NZNZ process, (2% NO in each stage or the imbalance (3% and 1% separation with the $N_1$ and $N_2$ stages). However, surprisingly after extraction the permanganate number was lowered significantly more for a given amount of ozone consumed (see FIG. 12). The permanganate number for 0.8% ozone consumed reduced from about 8.5 down to in the order of about 6 or over 2 points in FIG. 13. Also surprisingly, after the extraction stage, the viscosity at a given permanganate number increased significantly (see FIG. 14), namely at a permanganate number of about 6, the viscosity increased from about 14 up to 17 to 17.5 or an increase of 3 points.

It will be apparent that breaking down the process into at least 2 further stages, i.e. an NZ followed by a second NZ improved the viscosity for a given permanganate number quite substantially.

Having described the invention, modifications will be evident to those skilled in the art without departing from the spirit of the invention as defined in the appended claims.

We claim:

1. A method of bleaching pulp comprising adjusting the pH of the pulp to 1.5–3.5, chelating the pulp and reacting the chelated pulp in an N stage with nitric oxide in an amount of at least 1.5% by weight of NO based on the oven dry weight of the pulp and at a temperature of less than 35° C. passing said pulp from said N stage directly into a Z stage wherein said pulp is treated with ozone to consume 0.1 to 2% ozone based on the oven dry weight of the pulp, said Z stage being carried out at a temperature of less than 35° C. to produce a bleached pulp with a higher viscosity at a given permanganate number of less than 10 compared with a pulp similarly bleached but without an N stage.

2. A method as defined in claim 1 wherein said pulp is fluffed as it enters said N stage.

3. A method as defined in claim 2 wherein the consistency of the pulp during the N and Z stages is in the range of 30–55%.

4. A method as defined in claim 3 wherein the amount of NO applied in said N stage is in the range of 2–8% based on the oven dry weight of the pulp.

5. A method as defined in claim 4 wherein said N stage is carried out for a period of 5–10 minutes.

6. A method as defined in claim 4 further comprising a second N stage following said Z stage and a second Z stage following said second N stage.

7. A method as defined in claim 4 further comprising an extraction E stage following said Z stage.

8. A method as defined in claim 3 wherein said N stage is for a period of time of 5–10 minutes.

9. A method as defined in claim 8 further comprising a second N stage following said Z stage and a second Z stage following said second N stage.

10. A method as defined in claim 3 further comprising an extraction E stage following said Z stage.

11. A method as defined in claim 2 wherein the amount of NO applied in said N stage is in the range of 2–8% based on the oven dry weight of the pulp.

12. A method as defined in claim 11 wherein said N stage is for a period of time of 5–10 minutes.

13. A method as defined in claim 12 further comprising a second N stage following said Z stage and a second Z stage following said second N stage.

14. A method as defined in claim 13 further comprising an extraction E stage following said second Z stage.

15. A method as defined in claim 11 further comprising a second N stage following said Z stage and a second Z stage following said second N stage.

16. A method as defined in claim 15 further comprising an extraction E stage following said second Z stage.

17. A method as defined in claim 11 further comprising an extraction E stage following said Z stage.

18. A method as defined in claim 2 wherein said N stage is for a period of time of 5–10 minutes.

19. A method as defined in claim 18 further comprising an extraction E stage following said Z stage.

20. A method as defined in claim 2 further comprising a second N stage following said Z stage and a second Z stage following said second N stage.

21. A method as defined in claim 20 further comprising an extraction E stage following said second Z stage.

22. A method as defined in claim 2 further comprising an extraction E stage following said Z stage.

23. A method as defined in claim 1 wherein the amount of NO applied in said N stage is in the range of 2–8% based on the oven dry weight of the pulp.

24. A method as defined in claim 23 wherein said N stage is for a period of time of 5–10 minutes.

25. A method as defined in claim 24 further comprising a second N stage following said Z stage and a second Z stage following said second N stage.

26. A method as defined in claim 23 further comprising a second N stage following said Z stage and a second Z stage following said second N stage.

27. A method as defined in claim 26 further comprising an extraction E stage following said second Z stage.

28. A method as defined in claim 23 further comprising an extraction E stage following said Z stage.

29. A method as defined in claim 1 further comprising a second N stage following said Z stage and a second Z stage following said second N stage.

30. A method as defined in claim 29 further comprising an extraction E stage following said second Z stage.

* * * * *